US006405589B2

(12) United States Patent
Muessig et al.

(10) Patent No.: US 6,405,589 B2
(45) **Date of Patent: *Jun. 18, 2002**

(54) ARRANGEMENT AND METHOD FOR EXAMINING TEXTILE MATERIAL SECTIONS

(75) Inventors: Karl Muessig, Bad Koenigshofen; Roland Behr, Grossbardorf, both of (DE)

(73) Assignee: Texpa Maschinenbau GmbH & Co. (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/338,645

(22) Filed: Jun. 23, 1999

(30) Foreign Application Priority Data

Apr. 30, 1999 (DE) ..... 199 19 875

(51) Int. Cl.[7] ..... G01L 5/04
(52) U.S. Cl. ..... 73/159; 271/186
(58) Field of Search ..... 73/159, 160; 242/585; 162/287; 271/186, 19, 14, 8.1, 11

(56) References Cited

U.S. PATENT DOCUMENTS 4,583,727 A * 4/1986 Fort ..... 271/19
5,040,778 A * 8/1991 Cole, Jr. ..... 271/65
5,167,406 A * 12/1992 Cole, Jr. ..... 271/6
5,535,997 A * 7/1996 Croyle et al. ..... 271/12

* cited by examiner

*Primary Examiner*—Daniel S. Larkin
(74) *Attorney, Agent, or Firm*—McGlew and Tutle, P.C.

(57) ABSTRACT

An arrangement for examining a textile material section is provided, more particularly of toweling goods, by visual inspection by an examiner. In this respect, the examining arrangement has a laying area arranged in the field of vision of the examiner, in which the material section can be positioned so that it is laid flat for examination of the first side of the material section. In addition, the examining arrangement includes a turning device (2, 3), by which the material section (4), starting from the position for examining the first side (8) of the material section (4), can be reversed in such a manner that the material section (4) can be positioned so that it is laid flat in the laying area (6) for examination of the second side (10) of the material section (4).

15 Claims, 3 Drawing Sheets

ARRANGEMENT AND METHOD FOR EXAMINING TEXTILE MATERIAL SECTIONS

FIELD OF THE INVENTION

The invention relates to an arrangement for examining textile material sections, more particularly toweling goods, with visual inspection by an examiner, the examining arrangement comprising a laying area arranged in the field of vision of the examiner, in which the material section can be positioned so that it is laid flat for examination of the first side of the material section. Furthermore, the invention relates to a method for examining textile material sections.

BACKGROUND OF THE INVENTION

In the manufacture of textile goods, it is necessary in many cases at the end of the actual processing to undertake a final quality control of the workpieces in order to prevent the distribution of faulty workpieces. To this end, the workpieces are visually inspected by an examiner and can then be divided into different quality grades. Only the best quality grades are supplied to the customers. Average quality grades require secondary processing and can then be distributed. The worst quality grades represent reject goods. A final control of this type is particularly necessary in the processing of toweling products, for example in the manufacture of hand towels, since the loops of the toweling goods can easily be pulled during the processing, for example in the cutting and sewing machines, so that the quality of the toweling goods does not fulfil the level required for distribution.

For economic production, large problems arise if both sides of a flat material section need to be examined for the final quality control. This is necessary, for example, in toweling hand towels, since both sides of the toweling hand towel need to fulfil the stipulated quality standard. Since it is necessary to lay the toweling hand towel out flat for the inspection, it has been customary to date for one side of the hand towel to be visually inspected by an examiner following the sewing procedures and for the hand towel to then be manually turned over and laid flat, so that the second side can also be quality controlled. A plurality of manual working steps are required for this examination procedure, which in view of the high labor costs results in a considerable increase in the production costs. In addition, the turning of the material sections represents a working step which is physically strenuous for the examiner and also disturbs the examiner's concentration.

SUMMARY AND OBJECTS OF THE INVENTION

It is therefore the primary object of the present invention to provide an examining arrangement, by means of which the examination of textile material sections can be rendered more cost-effective. It is also the object of the present invention to provide a simple examination method for textile material sections.

In accordance with the invention, an examining arrangement is provided with a laying area arranged in the field of vision of the examiner, in which the material section can be positioned so that it is laid flat for examination of the first side of the material section. A turning device is provided, by means of which the material section, starting from the position for examining the first side of the material, can be reversed in such a manner that the material section can be positioned so that it is laid flat for the examination of the second side of the material in a laying area, which is arranged in the field of vision of the examiner. In this manner, the material section can be reversed by operating the turning device substantially without manual intervention by the examiner; this means that a mechanical reversal of the material section takes place following the quality control of the first side of the material section, so that the second side can then also be quality controlled by the examiner.

In principle, the structural design of the turning device is to be adapted to suit the respective specified requirements of a production line (the specific structural design may be one of several options).

It is particularly advantageous if the turning device comprises at least one gripping member, which is arranged above the laying area in the examining arrangement. The gripping member can be attached in the region of an edge of the material section and can be displaced substantially parallel to the surface of the laying area in the transverse and/or longitudinal direction of the material section. In order to reverse the material section, the gripping member is fixed to the edge of the material section and is displaced above the material section laid on the laying area. As a result of the displacement of the gripping member, the fixed edge of the material section is moved over the region of the material section resting upon the laying area. During the turning process, two material layers are thus formed, the upper material layer being drawn under the influence of the displacement movement of the gripping member over the lower material layer; the lower material layer rests upon the laying area, so that a relative movement between the lower and upper layers results. Once the gripping member has been moved far enough in one direction, a complete reversal of the material section can be attained without manual intervention.

The manner in which the gripping member is constructed is irrelevant according to the invention. More particularly, different mechanisms can be used in order to attain a fixing of the material section to the gripping member. For example, suction nozzles are conceivable, which can exert a suction effect upon the material section. It is particularly advantageous if the gripping member is constructed in the manner of tongs and can mechanically clamp the material section in certain areas by closure of the gripping member. Mechanically operating gripping members of this type can be constructed, for example, as linearly fixing gripper strips or can be constructed in the form of a plurality of local gripping tongs arranged adjacent to one another.

According to a preferred embodiment of the invention, the turning device comprises two gripping members which secure the material section substantially locally and which can be attached in the region of the corners of a material section in each case. In this manner, the structural outlay for the construction of the gripping member as a whole is minimized. In addition, it is possible to ensure an adequate and more particularly uniform clamping of the material edge in the region between the fixed material corners by corresponding measures, for example by a resilient mounting of at least one of the gripping members.

If it is to be possible to examine material sections of different widths in the examining arrangement, it is advantageous if the lateral distance between the two gripping members is variable. In this manner, the distance between the two gripping members can be adjusted to the distance between the corners of the material section. To this end, a linear drive for example, by means of which the gripping member can be linearly displaced in order to reverse the material sections, can be mounted on a carriage, which is adjustable in the transverse direction to the displacement movement. In this respect, it is sufficient in order to adjust the distance between the two gripping members if one linear drive is mounted so as to be stationary and a second linear drive is adjustable relative to the first linear drive.

If solely the active movement of the gripping member which is displaced above the laying area is used to reverse the material sections, then relatively large laying areas are required, since the edge of the material section which lies opposite the edge secured in the gripping member is not moved. It is therefore advantageous if at least one conveyor belt extends in the laying area, whose operation allows for the positioning of the material section in the laying area. To this end, for example, the top side of a rotating conveyor belt can be constructed as the laying area.

When the material section is reversed, the conveyor belt is then driven in the opposite direction to the direction of movement of the gripping member, so that the material layers of the material section which are superimposed during the reversal can each be moved in opposite directions. In this manner, it is possible for the edge of the material section secured in the gripping member and the opposite edge of the material section to change places as a result of the reversal of the material section, so that the required dimensions of the laying area can be minimized.

Of course, the examining arrangement according to the invention can be erected on its own, the supply and removal of the material sections to and from the examining arrangement being effected either manually or by correspondingly constructed supply and removal conveying devices, for example conveyor belts. Particularly high cost-effectiveness can be attained if the examining arrangement is arranged between a station for processing the material sections, more particularly with a sewing machine, and a station for folding and/or packaging the material sections, more particularly with a folding device. Processing, folding, and packaging stations of this type are known from the prior art and already have an extremely high level of automation. In the case of textile workpieces, in which a double-sided quality control of the surface is required, it was not possible to connect these extensively automated device stations, namely processing station and folding and/or packaging station, to a fully-automated production line, since the examination procedure required prior to folding and packaging had to be effected manually on account of the required reversal of the material section. By connecting a processing station on the one hand and a folding and/or packaging station on the other hand by means of an examining arrangement according to the invention comprising an automatic turning device, it is possible to realize fully automated production lines for workpieces of this type, in which, essentially without manual intervention, the finished product can be manufactured from raw material, examined, folded and/or packaged. The conveyance of the material sections into and between the various device stations can also be effected essentially without manual intervention, more particularly by the use of conveyor belts.

If the examining arrangement according to the invention is integrated into a production line, further economic advantages are obtained if the examining arrangement comprises an input device, at which the examiner can feed in the result of the visual inspection of the individual material sections, more particularly divided into different quality grades.

Dependent upon the input of the examination result by the examiner, the material sections can then be subjected to different further processing in the further course of the production line.

It is particularly advantageous if the individual material sections can be conveyed as a function of the examination result fed into the input device along different conveying paths by a corresponding control of the conveying devices. In this manner, a sorting of the material sections can be effected as a function of the respective quality grade, so that the best qualities are packaged immediately, lower qualities can be subjected to further processing and poor qualities can be transported away designated as rejects.

A particularly cost-effective method for examining textile material sections, more particularly of toweling goods, by visual inspection by an examiner is attained if the material section, for examination of the first side of the material, is positioned so that it is laid flat in the field of vision of the examiner and the material section, following examination of the first side, is then reversed by the operation of a turning device substantially without manual intervention in such a manner that the material section comes to lie with its second side facing upwards in the field of vision of the examiner. As a result of this method, it is possible for the examiner to concentrate exclusively on the task of examination, since the manual reversal of the material section is dispensed with.

If the turning device comprises a gripping member, then according to a preferred method variant, the gripping member is attached to an edge of the material section and is then displaced substantially parallel to the surface of the laying area until the material section is laid flat at least in sections on the laying surface of an examining arrangement. In this state, the first side of the material section can be visually inspected by the examiner. The gripping member is then displaced in the opposite direction substantially parallel to the surface of the laying area until the material section has been essentially completely reversed. In this state, the second side of the material section faces upwards, whilst the first side of the material section lies flat upon the laying area. In this state, the second side of the material can therefore be visually examined by the examiner.

In order to be able to execute the turning procedure on a smaller laying area in reduced time, a conveyor belt is to be provided, by means of which the material section can be moved in the laying area. This conveyor belt is driven at least periodically during the reversal of the material section by the displacement of the gripping member in such a manner that the part of the material section resting upon the laying area is moved in the opposite direction to the direction of movement of the gripping member. In this manner, the layers of the material which are superimposed during the reversal process are displaced in opposite directions relative to one another, so that the reversal of the material can be effected in reduced time and on a smaller surface area.

Following completion of the reversal procedure, the gripping member can be released, so that the material section comes to rest fully on the laying area. After completion of the quality control of the second side of the material section, the latter can then be advanced to following stations. During this process, the gripping member is returned to the starting position, so that the next material section can be gripped and reversed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1A:
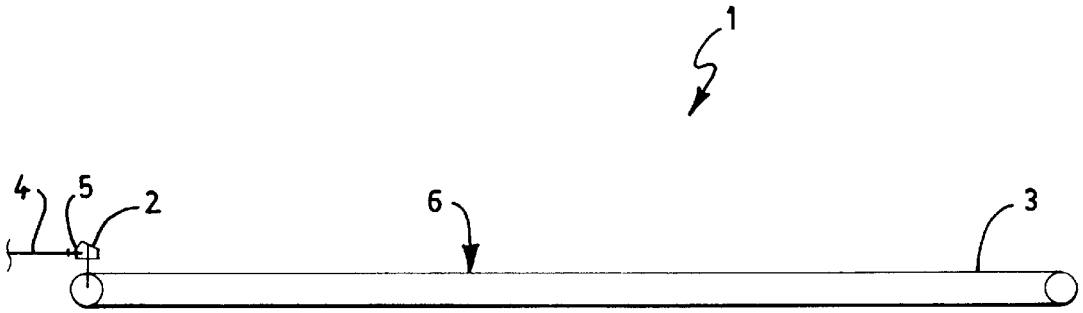
FIG. 1A is a side view of an examining arrangement during a phase of an examination procedure.
Figure 1B:
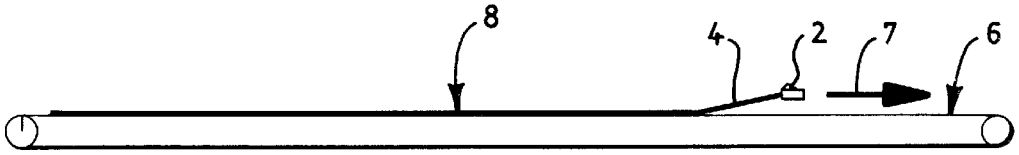
FIG. 1B is a side view of an examining arrangement during another phase of an examination procedure.
Figure 1C:
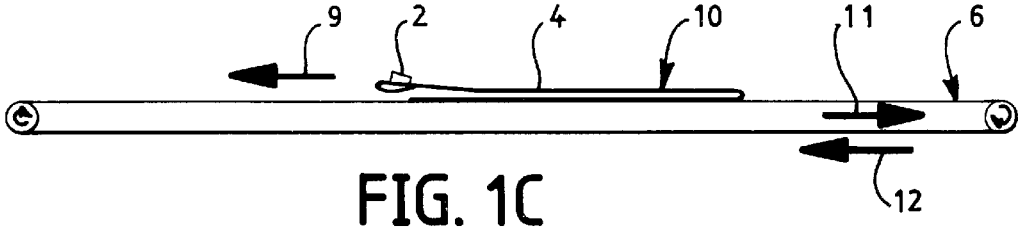
FIG. 1C is a side view of an examining arrangement during another phase of an examination procedure.
Figure 1D:
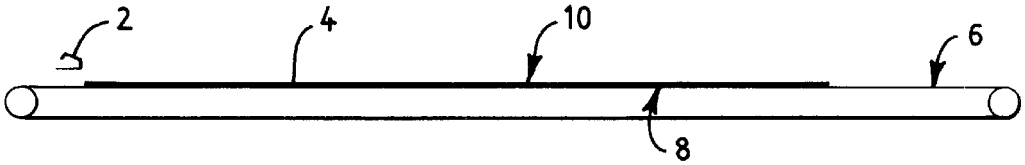
FIG. 1D is a side view of an examining arrangement during another phase of an examination procedure.

Referring to the drawings in particular, FIGS. 1A–1D show an examining arrangement 1 according to the invention with a gripping member 2 and a conveyor belt 3 in four different phases of an examination procedure, which are shown beneath one another. The examiner, who is employed to quality control the workpieces, is not shown in FIGS. 1A–1D. The linear drive for the displacement of the gripping member 2 is not shown in FIGS. 1A–1D for the sake of improved clarity.

At the start of the examination procedure, a material section 4 shown in part is laterally introduced to the examining arrangement 1 (FIG. 1A). As soon as the front edge 5 of the material section 4 is located above the left end of the conveyer belt 3, the gripping member 2 is brought to rest against the edge 5 and is fixed to the material section 4 by the closure of a tong mechanism. In the embodiment of an examining arrangement 1 according to the invention illustrated in FIGS. 1A–1D, the surface of the conveyor belt 3 represents the laying area 6, on which the material section 4 can be laid for the examination of the respective upwardly facing side.

Following the fixing of the gripping member 2 to the material section 4, the gripping member 2 is displaced in the direction of a movement arrow 7 parallel to the surface of the laying area 6 in the longitudinal direction of the material section 4. In this manner, the material section 4 is laid flat on the laying area 6, so that the first side 8 of the material section 4 can be quality controlled by the examiner.

As soon as the quality control of the first side 8 of the material section 4 is finished, which can be determined for example by the lapse of a given examination time, the gripping member 2 is displaced in the direction of movement arrow 9, which is opposed to the movement arrow 7. As a result of this opposite movement of the gripping member 2, the material section 4 is laid in two layers, the upper layer being drawn over the lower layer. As a result of this relative movement of the two material layers, a reversal of the material section 4 is attained. This means that the second side 10 of the material section 4 faces upwards, so that the second side 10 of the material section 4 can also be quality controlled by the examiner. In order to accelerate the turning process, the rotating conveyor belt 3 is driven in the direction of the movement arrows 11/12 during the displacement of the gripping member 2 in the direction of the movement arrow 9. Consequently, not only is the upper layer of the material section 4 drawn over the lower layer by means of the gripping member 2, but the lower layer of the material section 4 is also pushed beneath the upper layer. The sum of these two relative movements results in an acceleration of the turning procedure and a minimization of the required space on the laying area 6.

Following completion of the turning procedure, the gripping member 2 is released, so that the material section 4 comes to rest with its first side 8 fully on the laying area 6 and with its second side 10 facing upwards for quality control by the examiner.

Figure 2:
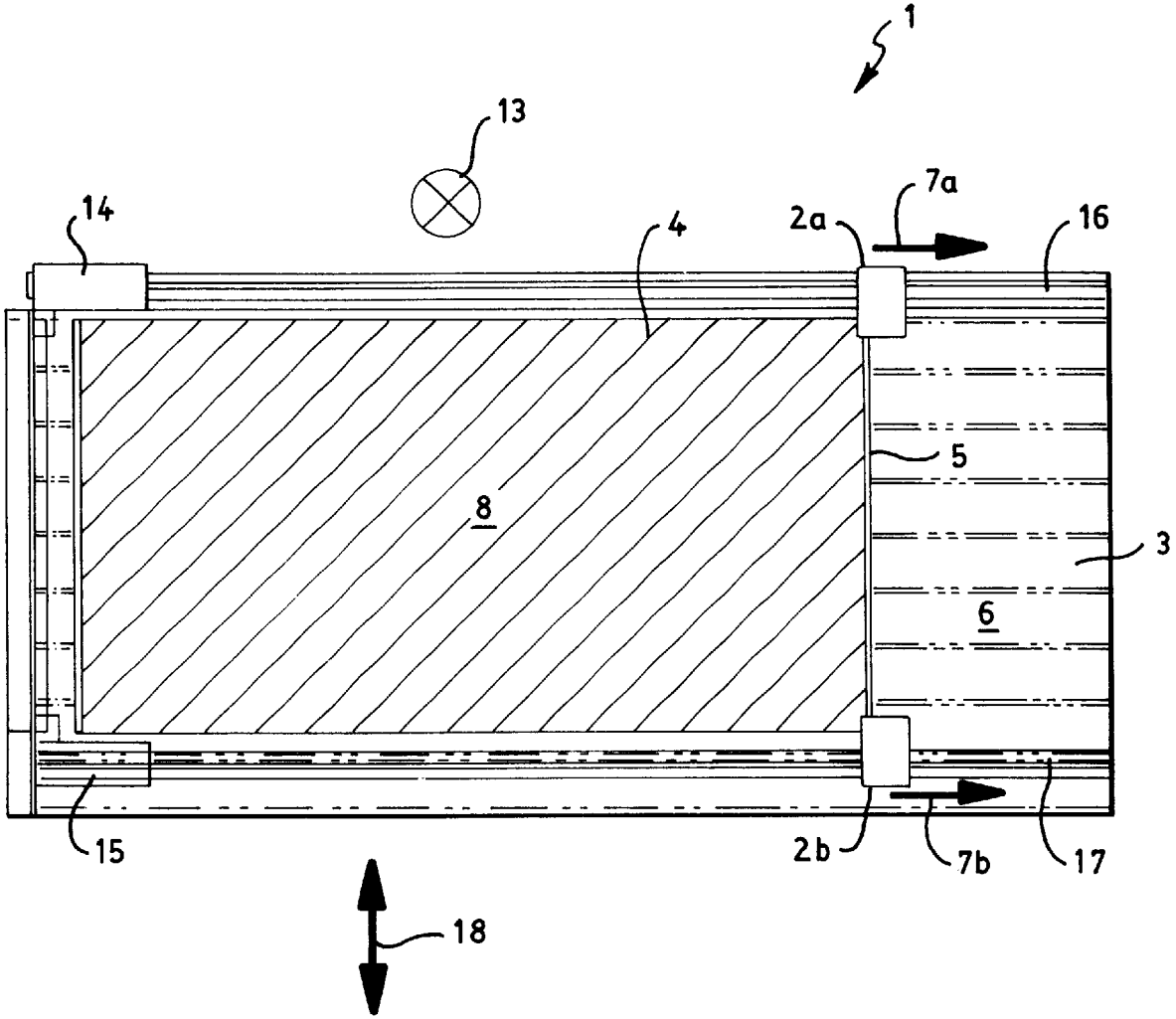
FIG. 2 is a top view of the examining arrangement according to FIG. 1.

FIG. 2 is a top view of the examining arrangement 1 with a schematically illustrated examiner 13. Two schematically illustrated gripping tongs 2*a* and 2*b* can be seen, which together form the gripping member 2 and each of which can be attached to the corners of the material section 4 in the region of the front edge 5.

Driven by the drive motors 14 and 15, the two gripping tongs 2*a* and 2*b* can be displaced along the rails 16 and 17. Following the fixing of the gripping tongs 2*a* and 2*b*, the material section 4 can therefore be drawn in the direction of the movement arrows 7*a* and 7*b*, so that a positioning of the material section 4 on the laying area 6 is possible.

In order to be able to reverse material sections of different widths using the examining arrangement 1, the gripping tongs 2*b* can be adjusted transversely to the direction of movement 7 according to the movement arrow 18 relative to the frame of the examining arrangement 1. The rail 16 with the drive motor 14 and the gripping tongs 2*a* is rigidly connected to the frame of the examining arrangement 1.

Figure 3:
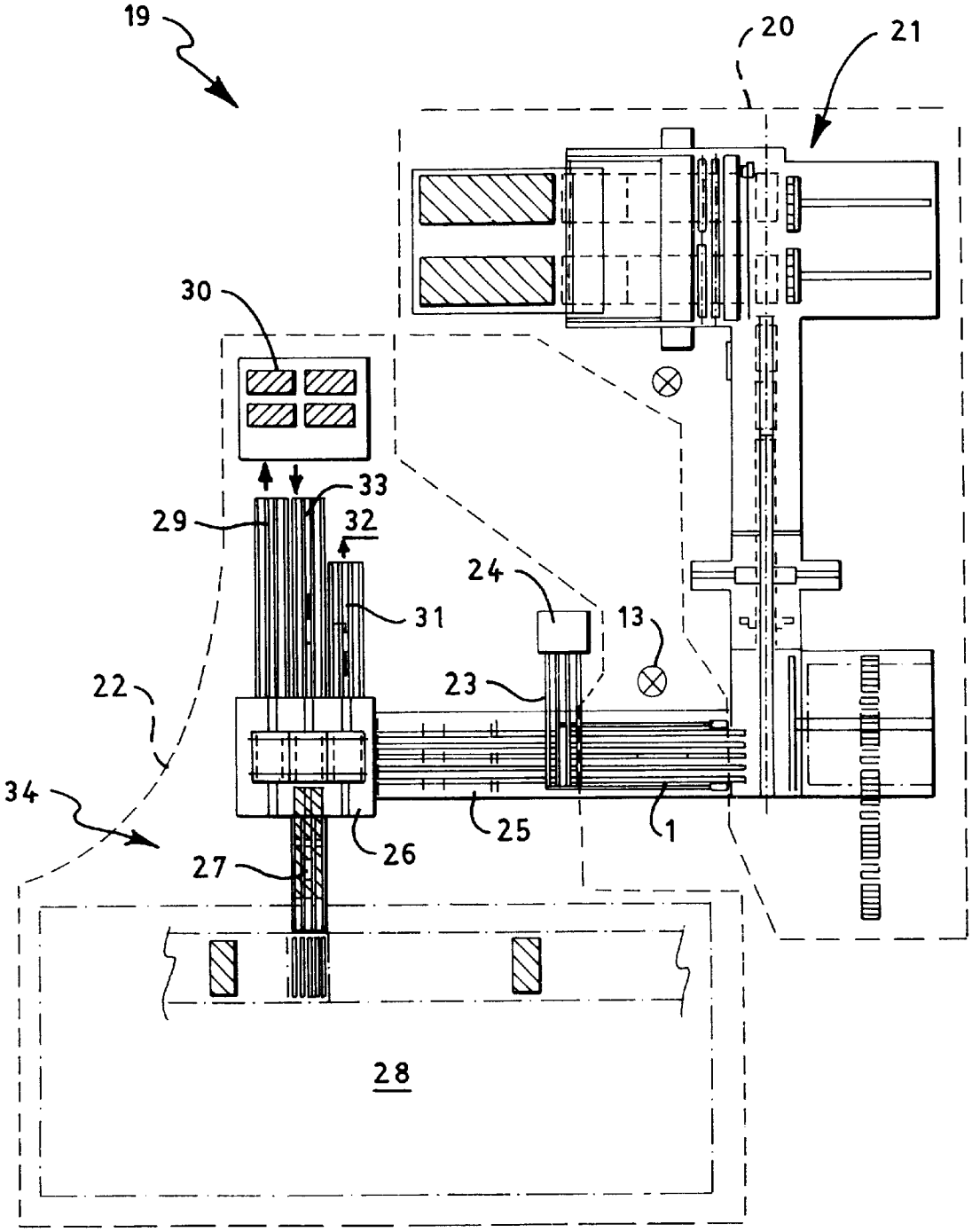
FIG. 3 is a top view of a production installation for manufacturing toweling hand towels with an examining arrangement.

FIG. 3 shows a production line 19 for the manufacture, examination, and packaging of toweling hand towels. In the manufacturing station 21 enclosed by a frame 20, the toweling hand towels are cut to size from raw material and sewn. After completion of the actual processing, the hand towels are automatically transferred to the examining arrangement 1, where both sides of the individual toweling hand towels are quality controlled by the examiner 13. Depending on the faults and quality defects determined by the examiner 13, a quality grade (1st quality, 1b quality, 2nd quality, and 3rd quality) is determined for each toweling hand towel and fed in at an input device, not shown.

After passing through the examining arrangement 1, the toweling hand towels are transferred to a sorting, folding, and packaging station 34 enclosed by a frame 22. The toweling hand towels which are only of 3rd quality, and are therefore rejects, are conveyed by means of a conveyor belt 23 into a reject container 24. All other toweling hand towels are folded in a folding station 25 and are then allocated in a sorting station 26 to different conveyor belts as a function of their associated quality grade. Toweling hand towels which correspond to the first quality are immediately supplied by means of a conveyor belt 27 to a packaging device 28, where they are packaged for distribution. Toweling hand towels which correspond to the second quality are advanced by means of a conveyor belt 29 to a transportation vehicle 30, so that hand towels of this quality grade can be supplied to a separate distribution line.

Hand towels of the quality grade 1b, which can be raised to the first quality grade by small secondary processing steps, are conveyed by means of a conveyor belt 31 into the region of a manual work station 32, where the secondary processing steps can be carried out. The reworked hand towels are then conveyed by means of the conveyor belt 33 back to the sorting station 26 and from here are supplied by means of the conveyor belt 27 together with the hand towels of first quality grade to the packaging station 28.

While a specific embodiment of the invention has been shown and described in detail to illustrate the application of the principles of the invention, it will be understood that the invention may be embodied otherwise without departing from such principles.

What is claimed is:

1. An arrangement for examining a textile material section, by visual inspection by an examiner, the examining arrangement comprising a laying area arranged in the field of vision of the examiner, in which the material section is positionable to be laid flat for examination of a side of the material section, the arrangement comprising:

a turning device for reversing the material section, starting from a position for examining the first side of the material section such that the material section is positioned so that it is laid flat in the laying area for examination of a second side of the material section, the turning device includes at least one gripping member arranged above the laying area, said gripping member being attachable to an edge of the material section, said gripping member being displaceable substantially parallel to the surface of the laying area in a tranverse and/or longitudinal direction of the material section in order to reverse the material section wherein a lateral distance between said gripping member and an opposite edge of the material section is variable; and at least one conveyor belt being mounted relative to said gripping member having a side extending in the laying area, said side conveyor belt being movable for positioning the material section in the laying area.

2. The examining arrangement according to claim 1, wherein the gripping member includes tongs for mechanically clamping a material section in certain regions by closing the gripping member.

3. The examining arrangement according to claim 1, wherein said turning device comprises two said gripping members, which secure the material section substantially locally and can be attached in each case ub a region of corners of the material section.

4. The examining arrangement according to claim 3, wherein a lateral distance between said two gripping members is variable.

5. The examining arrangement according to claim 1, wherein the examining arrangement is arranged between a station for processing material sections including a sewing machine, and a station for folding and/or packaging the material sections, with a folding device, wherein the conveyance of the material sections in and between the different device stations is effected essentially without manual intervention by the operation of conveying devices, more particularly conveyor belts.

6. The examining arrangement according to claim 1, wherein the eaxmining arrangement comprises an input device, at which the examiner can feed in a result of individual visual examinations divided into different quality grades.

7. An examining arrangement according to claim 6, further comprising a plurality of conveying paths, wherein individual material sections can be conveyed as a function of the respective examination result fed into the input device along different said conveying paths by corresponding control of conveying devices.

8. An arrangement for visually examining a textile material by an examiner, the arrangement comprising:

a laying area arranged in a field of vision of the examiner;

a gripping member arranged at said laying area and displaceable back and forth with respect to said laying area, said gripping member gripping the textile material and moving the textile material alomg said laying area wherein a lateral distance between said gripping member and an opposite edge of the textile material is variable;

a conveyor belt having a side arranged on said laying area and movable with respect to said laying area, said side of said conveyor belt being movable along with said laying area in a direction opposite a direction of movement of said gripping member along said laying area; and a rail, said gripping member displaced along said rail.

9. The arrangement in accordance with claim 8, further comprising:

a drive motor for moving said gripping member back and forth along said laying area.

10. The arrangement according to claim 8, wherein said gripping member is arranged above the laying area, said gripping member being attachable in a region of an edge of the textile material, said gripping member mounted relative to said conveying belt being substantially parallel to a surface of the laying area in a transverse and/or longitudinal direction of the textile material in order to reverse the textile material.

11. The examining arrangement according to claim 10, wherein operation of said conveyor belt allows for the positioning of the material section in the laying area.

12. A method for visually examining a textile material by an examiner, the method comprising the steps of:

providing a laying area arranged in a field of vision of the examiner;

providing a gripping member arranged at said laying area;

gripping the textile material with said gripping member;

moving said gripping member with the textile material back and forth along said laying area;

locating said gripping member in a position to accommodate varying widths of the textile material;

providing a conveyor belt having a side arranged on said laying area; and simultaneously moving said side of said conveyor along said laying area and moving said gripping member along said laying area in opposite directions.

13. The method according to claim 12, wherein said gripping member is attached to an edge of the textile material, the gripping member is displaced substantially parallel to a surface of a laying area until the textile material is laid flat at least in sections on the laying area, the gripping member is then displaced, following examination of a first side of the textile material by the examiner substantially parallel to the surface of the laying area in an opposite direction until the textile material is essentially fully reversed, so that the first side of the textile material rests upon the laying area and a second side of the textile material sections faces upwards.

14. The method according to claim 13, further comprising displacing the textile material with said conveyor belt in the laying area, driving the conveyor belt during the reversal of the textile material by the displacement of the gripping member at least periodically in such a manner that part of the textile material which rests directly on the laying area is displaced in an opposite direction to a direction of movement of the gripping member.

15. A method according to claim wherein the gripping member is released following the reversal of the material section.

* * * * *